US005992520A

United States Patent [19]

Schultz et al.

[11] Patent Number: 5,992,520

[45] Date of Patent: Nov. 30, 1999

[54] ANNULUS PRESSURE OPERATED DOWNHOLE CHOKE AND ASSOCIATED METHODS

[75] Inventors: Roger L. Schultz, Stillwater, Okla.; Kent Beck, Copper Canyon, Tex.

[73] Assignee: Halliburton Energy Services, Inc., Dallas, Tex.

[21] Appl. No.: 08/929,755

[22] Filed: Sep. 15, 1997

[51] Int. Cl.[6] ..... E21B 34/10; E21B 49/08

[52] U.S. Cl. ..... 166/264; 166/317; 166/332.3; 166/373; 166/376

[58] Field of Search ..... 166/264, 317, 166/332.2, 332.3, 334.2, 373, 374, 375, 376

[56] References Cited

U.S. PATENT DOCUMENTS

| | | | |
|---|---|---|---|
| 3,414,059 | 12/1968 | Nutter | 166/334.2 X |
| 3,664,415 | 5/1972 | Wray et al. | 166/264 X |
| 3,856,085 | 12/1974 | Holden et al. | 166/264 |
| 3,964,544 | 6/1976 | Farley et al. | 166/264 X |
| 4,278,130 | 7/1981 | Evans et al. | 166/332.3 |
| 4,553,598 | 11/1985 | Meek et al. | 166/317 |
| 4,760,879 | 8/1988 | Pringle | 166/117.5 |
| 4,871,019 | 10/1989 | Haley et al. | 166/332.3 X |

*Primary Examiner*—George Suchfield
*Attorney, Agent, or Firm*—Paul I. Herman; Marlin R. Smith

[57] ABSTRACT

A downhole choke and associated methods provide enhanced efficiency and accuracy in well sampling and testing operations due to its capability for substantially minimizing the amount of time needed to establish steady state flow conditions in a well, and the ability to sample fluids downhole at varying downhole flow restrictions. In a described embodiment, a downhole choke is operable to restrict fluid flow therethrough by applying a predetermined fluid pressure to an annulus formed between the choke and the wellbore. The downhole choke has an axial flow passage formed therethrough, a portion of which has interchangeable flow areas. The flow areas are interchanged upon application of the predetermined fluid pressure, and again interchanged upon expiration of a time delay. One of the flow areas permits substantially unrestricted fluid flow therethrough, and another of the flow areas permits restricted flow therethrough.

45 Claims, 14 Drawing Sheets

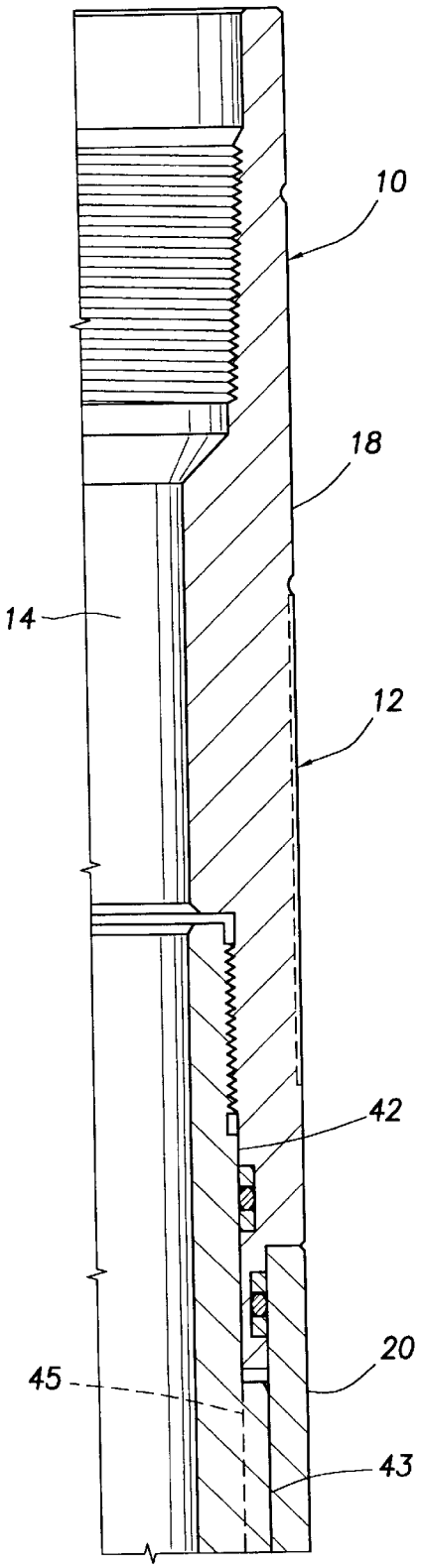
FIG. 1A
FIG. 1B
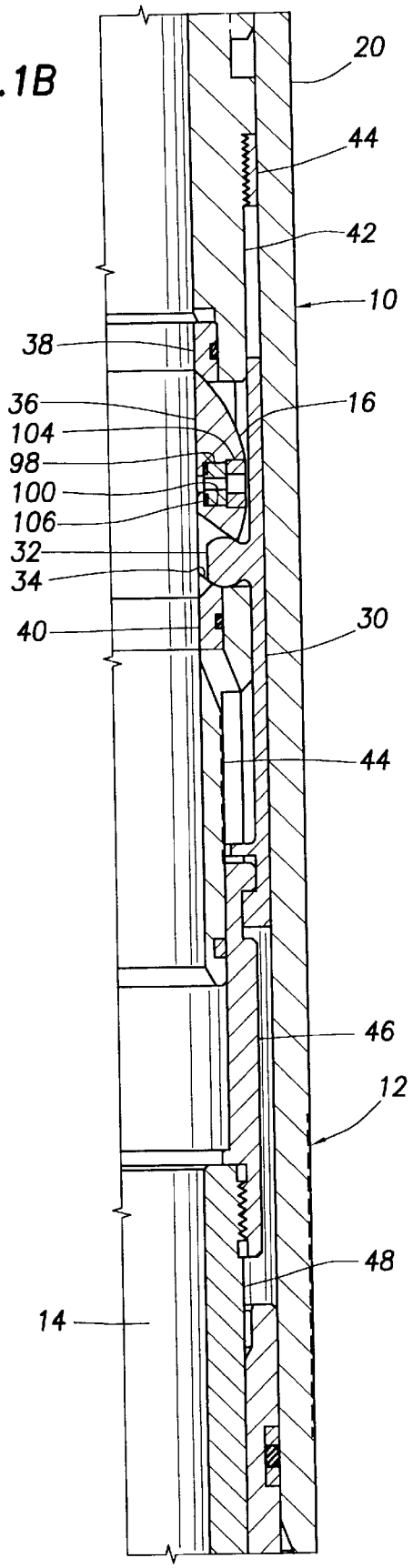

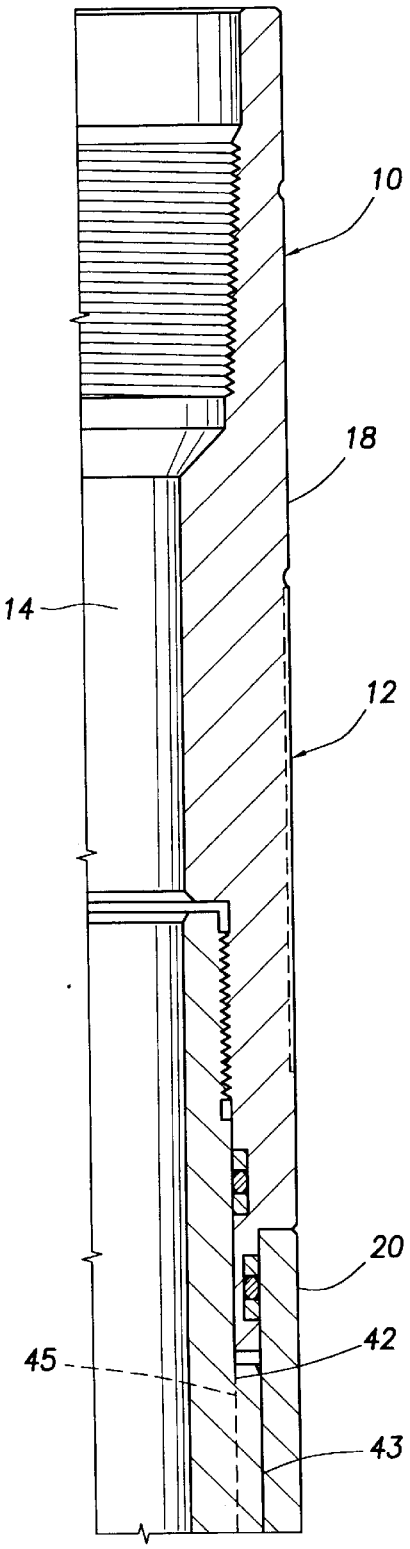
FIG.2A
FIG.2B
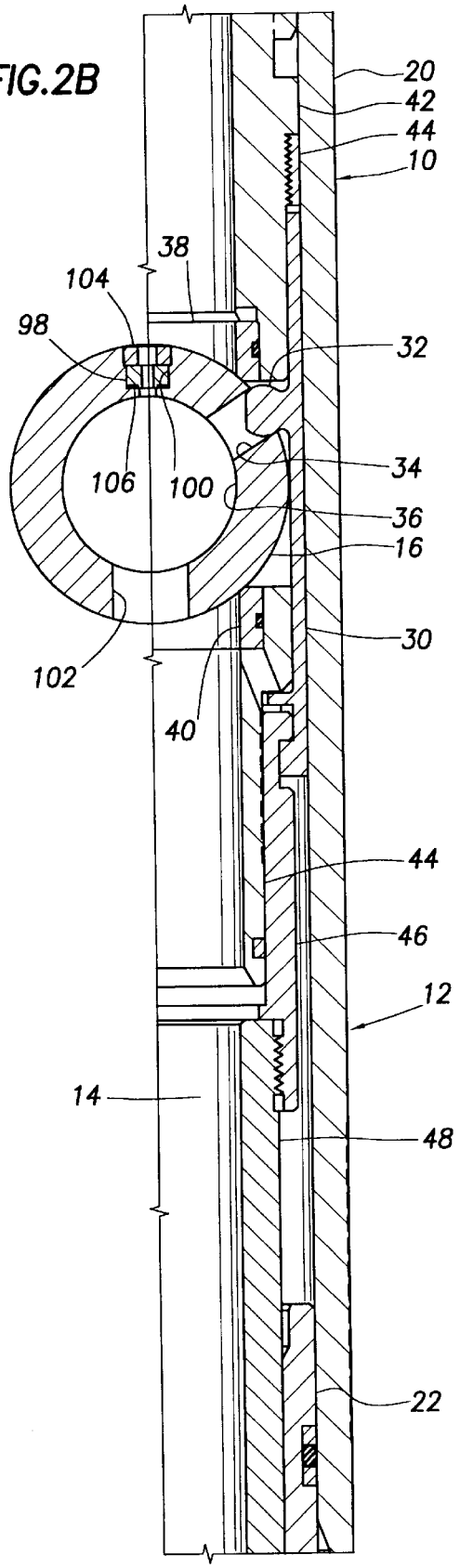

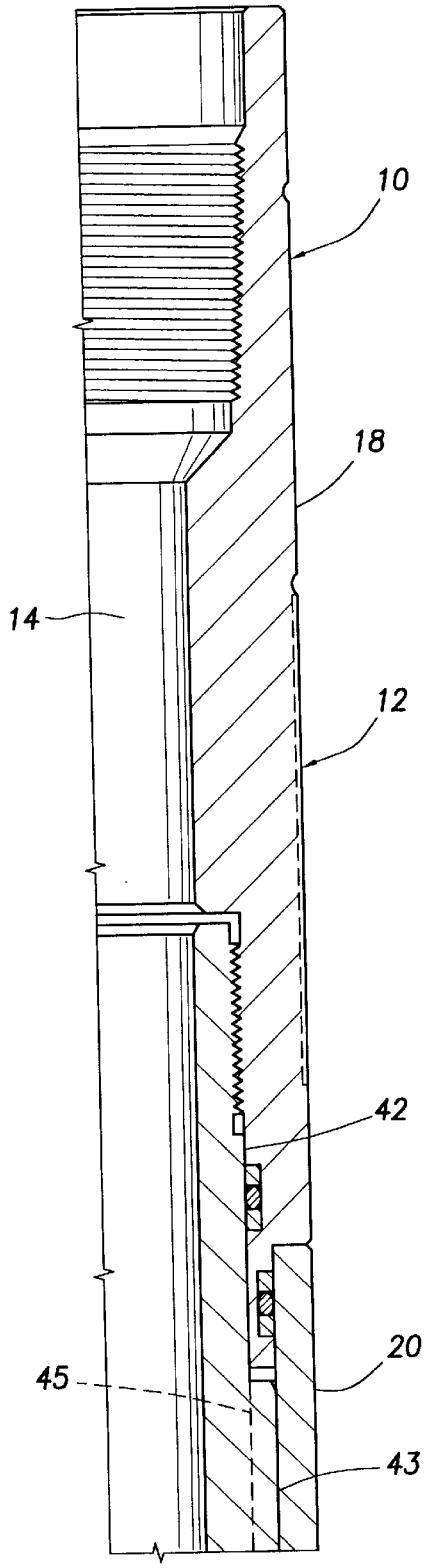
FIG.3A
FIG.3B
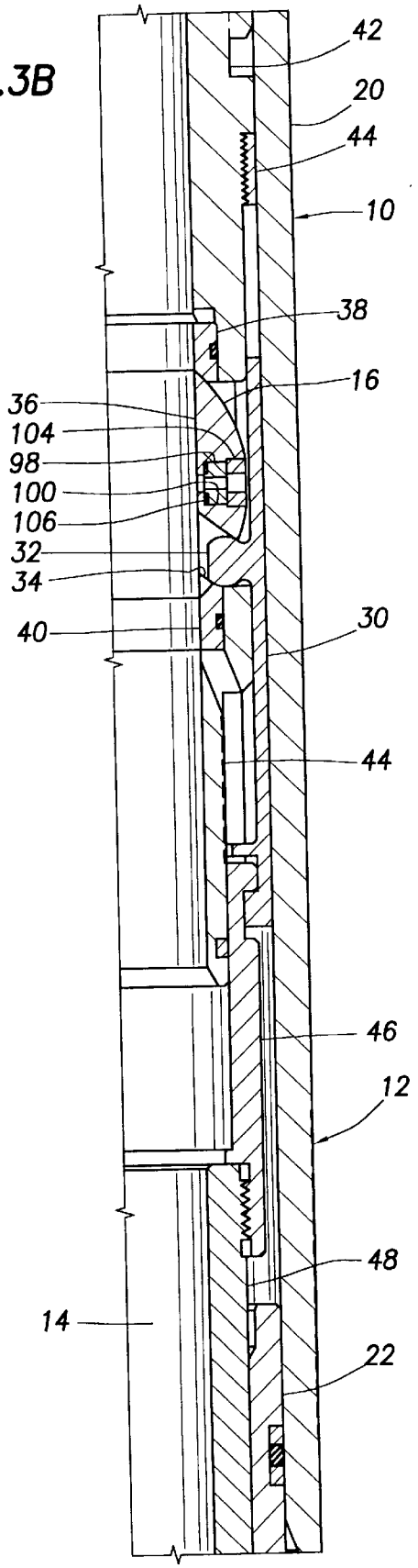

ANNULUS PRESSURE OPERATED DOWNHOLE CHOKE AND ASSOCIATED METHODS

BACKGROUND OF THE INVENTION

The present invention relates generally to testing and sampling operations performed in subterranean wells and, in an embodiment described herein, more particularly provides an annulus pressure operated downhole choke and associated methods.

In a conventional fluid sampling operation performed for a subterranean well, a sample chamber is attached to a tubing string and positioned within the well in order to take an in situ sample of the fluid flowing through the tubing string. Preferably, the sample is taken in relatively close proximity to a formation from which the fluid originates. Additionally, it is generally desired to take the sample in steady state flow conditions and at a fluid pressure greater than the bubble point of any oil in the sample.

To achieve the desired fluid pressure at the downhole sample chamber while the fluid is flowing through the tubing string, a choke is typically installed at the earth's surface and connected to the tubing string to restrict fluid flow through the tubing string at the earth's surface. However, due to the usually great distance between the choke and the formation and resulting wellbore storage effects, the desired steady state flow is not established until a substantial amount of time after flow through the choke is commenced. If a sample is taken during this long period of unsteady flow, the sample may include proportions of oil and gas which are uncharacteristic of the formation fluid and, therefore, impair any analysis of the formation relating, for example, to optimum rates of production from the formation, etc.

Furthermore, it is at times helpful to take additional samples at differing downhole fluid pressures, differing flow rates, etc., in order to more accurately analyze the formation, predict the optimum rate of production, etc. In these situations a corresponding additional choke having a different flow restriction is installed at the earth's surface prior to taking each of the additional samples. Unfortunately, each time an additional choke is installed, a substantial period of time must again elapse before steady state flow conditions are established.

The expense of performing these operations could be significantly reduced if an apparatus and/or method were developed to minimize or eliminate the time period spent waiting for flow conditions to stabilize at the sample chamber. Thus, from the foregoing, it can be seen that it would be quite desirable to provide a choke which may be installed in the tubing string in close proximity to the sample chamber, thereby substantially eliminating the effect of wellbore storage on fluid flow through the choke. In addition, it would be desirable to control the downhole choke using fluid pressure applied to the annulus at the earth's surface, and to alternately provide substantially unrestricted flow and restricted flow through the choke. It would also be desirable to provide methods whereby a downhole choke may be operated by application of annulus pressure, and methods whereby multiple downhole chokes and multiple sample chambers may be installed in the well to enhance analysis of the formation. It is accordingly an object of the present invention to provide such a downhole choke and associated methods of using same.

SUMMARY OF THE INVENTION

In carrying out the principles of the present invention, in accordance with an embodiment thereof, a downhole choke is provided which is actuated by annulus pressure applied thereto, utilization of which permits greatly reduced or eliminated periods of time between restricting fluid flow from a formation and stabilizing that fluid flow. The choke has one configuration in which substantially unrestricted fluid flow is permitted therethrough, and a configuration in which the fluid flow is restricted. Associated methods are also provided.

In broad terms, a downhole choke is provided which includes a housing and an axial flow passage formed therethrough. A portion of the flow passage has interchangeable flow areas. The flow areas are interchanged by applying fluid pressure to the exterior of the housing. In this manner, the restriction to fluid flow through the choke may be controlled from the earth's surface.

In another aspect of the present invention, a downhole choke is provided which includes a closure member positionable relative to a flow passage extending axially through a tubular outer housing. The closure member is selectively positionable in one position in which it permits substantially unrestricted fluid flow through the flow passage, and another position in which the closure member permits restricted fluid flow through the flow passage.

In a described embodiment, the closure member is a spherical member having several openings formed therethrough. One opening has a diameter which is approximately equal to the diameter of the flow passage, and so, when that opening is aligned with the flow passage, fluid flow is substantially unrestricted. Another opening has a diameter which is smaller than the flow passage diameter, thereby restricting fluid flow when this other opening is aligned with the flow passage.

Additionally, the smaller opening may be formed through a separate flow restrictor attached to the closure member. In this manner, the flow restrictor may be replaced conveniently without replacing the entire closure member, the flow restrictor may be made of a special erosion resistant material, and various opening diameters may be provided on various flow restrictors so that a desired flow restriction may be obtained as needed.

In yet another aspect of the present invention, a time delay mechanism is provided in a downhole choke. The time delay mechanism is used to provide a time delay between actuation of the choke and return of the choke to substantially unrestricted flow therethrough. A fluid sample may be taken during the time delay. The choke conveniently and automatically returns to substantially unrestricted flow therethrough upon expiration of the time delay.

In a method of performing a sampling operation disclosed herein, multiple downhole chokes and multiple sampling chambers are interconnected in a tubing string and positioned within a wellbore. One of the chokes is actuated and a first fluid sample is acquired while flow is restricted through the choke. Another one of the chokes is then actuated and a second fluid sample is acquired while flow is restricted through that choke. By configuring each of the chokes to have a different restriction to fluid flow therethrough, the samples are indicative of downhole fluid properties at different rates of production, fluid pressures, etc.

These and other aspects, features, advantages, benefits and objects of the present invention will become apparent to one of ordinary skill in the art upon careful consideration of the detailed description of representative embodiments of the invention hereinbelow and the accompanying drawings.

BRIEF DESCRIPTION OF THE DRAWINGS

FIGS. 1A–1E are quarter-sectional views of successive axial sections of an annulus pressure operated downhole choke embodying principles of the present invention, the downhole choke being shown in an open configuration thereof;

FIGS. 2A–2E are quarter-sectional views of successive axial sections of the downhole choke of FIGS. 1A–1E, the downhole choke being shown in a choke configuration thereof;

FIGS. 3A–3E are quarter-sectional views of successive axial sections of the downhole choke of FIGS. 1A–1E, the downhole choke being shown in a reopened configuration thereof;

DETAILED DESCRIPTION

Figure 1C:
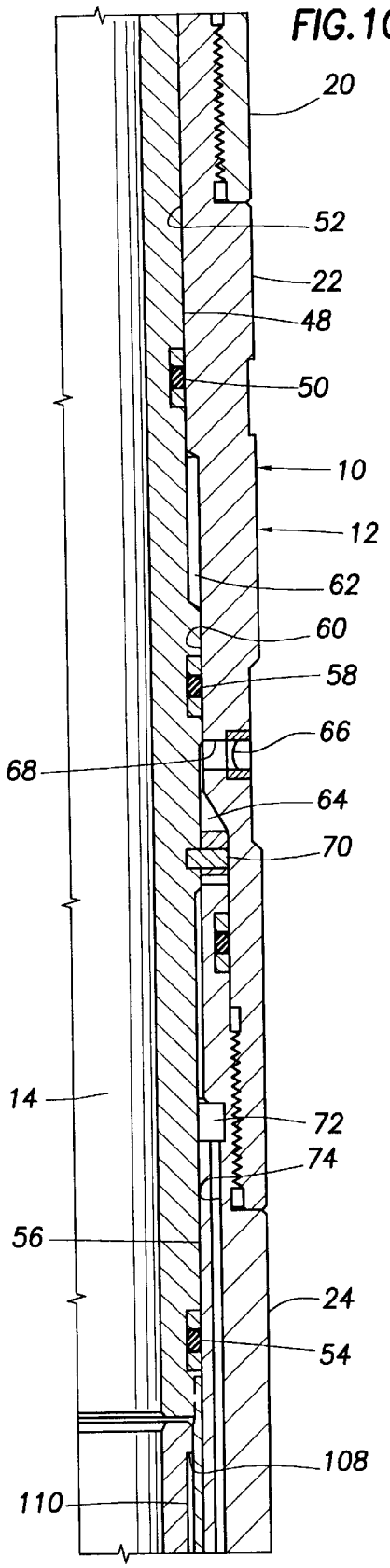

Representatively illustrated in FIGS. 1A–1E is an annulus pressure operated downhole choke 10 which embodies principles of the present invention. Although the choke 10 is shown in successive axial sections, it is to be understood that it is actually a continuous assembly. In the following description of the choke 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The choke 10 includes a generally tubular outer housing assembly 12 which radially outwardly surrounds an internal axial flow passage 14 extending therethrough. When interconnected in a tubing string (not shown in FIGS. 1A–1E), the flow passage 14 is in fluid communication with the interior of the tubing string. The choke 10 also includes a closure member 16 disposed within the outer housing assembly 12 and which is displaceable relative to the flow passage 14 to selectively restrict fluid flow through the flow passage.

The outer housing assembly 12 includes an upper sub 18, a closure housing 20, an actuator housing 22, an intermediate housing 24, a piston housing 26 and a lower sub 28. The upper and lower subs 18, 28 are configured for threaded and sealing attachment of the outer housing assembly 12 at its opposite ends to a tubing string in a conventional manner. In addition, each element of the outer housing assembly 12 is threadedly and sealingly attached to at least one of the other elements, so that the outer housing assembly forms a generally continuous fluid tight envelope about the flow passage 14.

The closure member 16 is representatively illustrated as a spherical element or ball, which is displaceable relative to the flow passage 14 by rotating the ball. However, it is to be clearly understood that other types of closure members may be utilized in place of the ball 16, and other manners of displacing the closure member, may be utilized without departing from the principles of the present invention. For example, a gate-type closure member, which is displaced laterally relative to the flow passage 14, could be used in a choke constructed in accordance with the principles of the present invention.

Rotation of the ball 16 is accomplished by axially displacing an opposing pair of actuator sleeves 30 (only one of which is visible in FIG. 1B) relative to the closure housing 20. Each of the actuator sleeves 30 has an inwardly extending projection 32 formed internally thereon which engages an obliquely oriented receptacle 34 formed on the ball 16. This manner of rotating a ball within a housing by axially displacing a sleeve and/or projection engaged therewith is well known to those of ordinary skill in the art and is utilized in conventional items of equipment, such as tester valves, retainers, etc. having ball valves therein.

As shown in FIGS. 1A–1E, the choke 10 is in an open configuration thereof. The ball 16 is positioned so that an opening 36 formed therethrough is generally axially aligned with the flow passage 14. The opening 36 has a diameter and flow area which are approximately equal to those of the flow passage 14. Thus, in the open configuration, the opening 36 permits substantially unrestricted flow of fluid through the flow passage 14, that is, the opening does not present a significant restriction to fluid flow therethrough.

It will be readily appreciated that the opening 36 forms a portion of the flow passage 14 in the open configuration of the choke 10 representatively illustrated in FIGS. 1A–1E. As will be more fully described hereinbelow, the ball 16 has additional openings formed therein with different diameters and flow areas which may also form portions of the flow passage 14 when the ball is appropriately positioned. Thus, the flow passage 14 has a portion thereof with interchangeable flow areas, depending upon the orientation of the ball 16 relative thereto.

The outer side surface of the ball 16 is sealingly engaged by axially opposing circumferential seats 38, 40. The upper seat 38 is internally and sealingly received in a generally tubular upper seat retainer 42, which is threadedly and sealingly attached internally to the upper sub 18. The upper seat retainer 42 has a series of axially extending and circumferentially spaced apart splines 43 formed externally thereon which engage complementarily shaped splines 45 formed internally on the closure housing 20. The splines 43, 45 prevent radial displacement of the upper seat retainer 42 relative to the closure housing 20, and the internal splines 45 limit axial displacement of the closure housing relative to the upper sub 18 and upper seat retainer. The lower seat 40 is internally and sealingly received in a generally tubular lower seat retainer 44 disposed within the closure housing 20.

A generally tubular coupling 46 is engaged at its upper end with the actuator sleeves 30, and is threadedly attached at its lower end to a generally tubular operating mandrel 48. Note that the engagement between the coupling 46 and the actuator sleeves 30 constrains the actuator sleeves against axial displacement relative to the coupling, but does not prevent the actuator sleeves from displacing circumferentially relative thereto when the ball 16 is rotated. In this manner, the operating mandrel 48, coupling 46 and actuator sleeves 30 axially displace together, and the actuator sleeves may also displace circumferentially relative to the coupling.

When desired, the operating mandrel 48 is displaced axially to cause rotation of the ball 16 by creating a pressure unbalance acting on the operating mandrel. A circumferential seal 50 is carried externally on the operating mandrel 48 and sealingly engages a seal bore 52 formed internally on the actuator housing 22. Another circumferential seal 54 is axially spaced apart from the seal 50, is carried externally on the operating mandrel 48 and sealingly engages a seal bore 56 formed internally on the intermediate housing 24.

The seal bore 56 is equal in diameter to the seal bore 52, and atmospheric pressure is contained between the seals 50, 54. Thus, no matter the fluid pressure in the flow passage 14, the operating mandrel 48 is not biased axially by the fluid pressure acting on the seals 50, 54. However, another circumferential seal 58 is carried externally on the operating mandrel 48 axially between the seals 50, 54 and sealingly engages another seal bore 60 formed internally on the actuator housing 22. The seal bore 60 is somewhat larger in diameter than the seal bores 52, 56.

It will be readily appreciated by a person of ordinary skill in the art that if fluid pressure greater than atmospheric is admitted into an annular chamber 64 formed radially between the actuator housing 22 and the operating mandrel 48 axially between the seal 58 and the seal 54, the operating mandrel will become pressure unbalanced and will be biased axially upward thereby. If the operating mandrel 48 is displaced axially upward by the biasing force produced by such pressure unbalancing, an annular chamber 62 formed radially between the actuator housing 22 and the operating mandrel will be axially compressed, and the annular chamber 64 will be axially extended.

In order to admit fluid pressure into the annular chamber 64, a rupture disk 66 is sealingly installed into an opening 68 formed radially through the actuator housing 22. The opening 68 is in fluid communication with the annular chamber 64, so that, when the rupture disk 66 ruptures, fluid pressure on the exterior of the outer housing assembly 12 will be permitted to enter the annular chamber. The rupture disk 66 is made to rupture by applying a predetermined fluid pressure on the exterior of the outer housing assembly 12. When interconnected in a tubing string and positioned within a subterranean well, the exterior of the outer housing assembly 12 is exposed to an annulus formed radially between the tubing string and the wellbore and extending to the earth's surface. Thus, a predetermined fluid pressure may be applied to the annulus at the earth's surface to rupture the rupture disk 66, admit fluid pressure greater than atmospheric to the annular chamber 64, and thereby upwardly bias the operating mandrel 48.

The operating mandrel 48 is secured against axial displacement relative to the outer housing assembly 12 by one or more shear members 70. In the representatively illustrated choke 10, a shear pin 70 is installed radially through the intermediate housing 24 and into the operating mandrel 48. When the upwardly biasing force produced by the fluid pressure admitted into the chamber 64 exceeds the shear strength of the shear pin 70, the pin shears and permits the operating mandrel 48 to displace axially upward to cause rotation of the ball 16.

Preferably, the shear pin 70 is appropriately designed so that it will shear at a fluid pressure less than that at which the rupture disk 66 ruptures, that is, at a pressure less than the predetermined fluid pressure described above. However, it is to be understood that the shear pin 70 may shear at a pressure greater than the predetermined fluid pressure without departing from the principles of the present invention. In that case, the rupture disk 66 would rupture at the predetermined fluid pressure, and then additional fluid pressure could be applied to the exterior of the outer housing assembly 12 to shear the shear pin 70 and upwardly displace the operating mandrel 48.

At this point it should be noted that in a choke constructed in accordance with the principles of the present invention, it is not necessary for the rupture disk 66 to be provided. For example, fluid pressure could be admitted into the annular chamber 64 through the opening 68 to pressure unbalance the operating mandrel 48, and the fluid pressure could be increased when desired to a predetermined fluid pressure, at which time the shear pin 70 would shear and the operating mandrel would be displaced axially upward to cause rotation of the ball 16. In the representatively illustrated choke 10, however, the rupture disk 66 is utilized to maintain atmospheric pressure in the chamber 64 for the additional purpose of delaying initiation of a time delay mechanism within the choke until the operating mandrel 48 is displaced axially upward to rotate the ball 16, and so use of the rupture disk is preferred in the choke 10 shown in the accompanying figures.

When the rupture disk 66 ruptures, fluid pressure enters the chamber 64 as described above. The chamber 64 is in fluid communication with a fluid passage 72, which extends axially downward from the chamber 64 radially between the operating mandrel 48 and the actuator and intermediate housings 22, 24, through a hole 74 formed axially through the intermediate housing, and radially between the piston housing 26 and a generally tubular intermediate mandrel 76 disposed within the intermediate and piston housings. The fluid passage 72 terminates at an annular piston 78 axially reciprocably and sealingly disposed radially between the piston housing 26 and the intermediate mandrel 76.

Figure 1D:
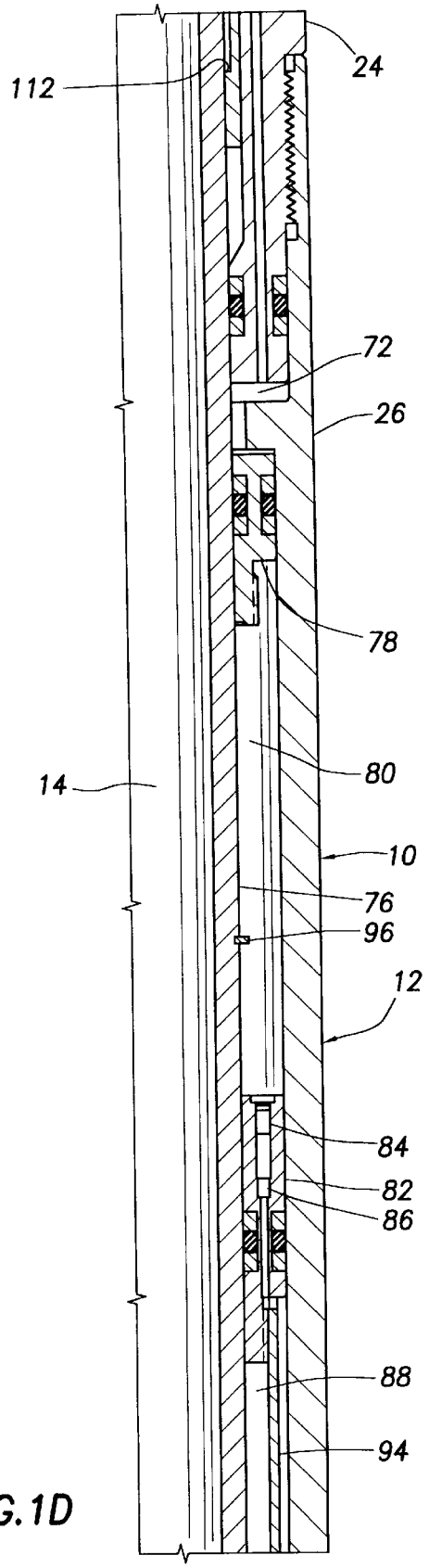
Figure 1E:
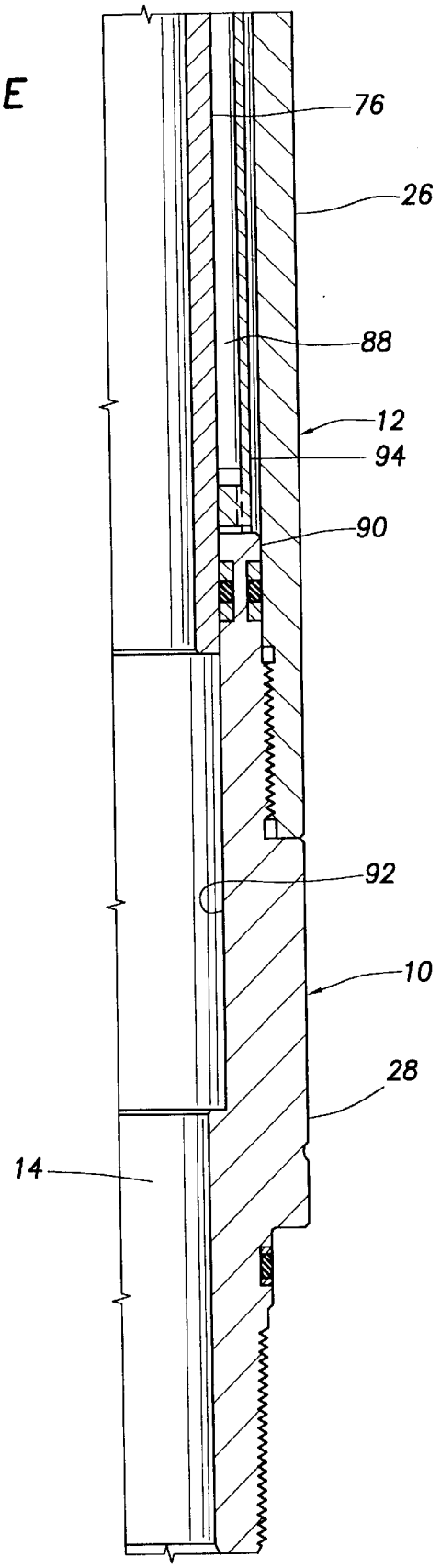

It will be readily appreciated that fluid pressure in the fluid passage 72 will act to bias the piston 78 axially downward when the rupture disk 66 ruptures. As shown in FIG. 1D, the piston 78 is upwardly disposed relative to an annular chamber 80 formed radially between the piston housing 26 and intermediate mandrel 76 and axially between the piston 78 and a metering piston 82. The metering piston 82 is generally annular shaped and is sealingly and axially reciprocably disposed radially between the piston housing 26 and the intermediate mandrel 76.

An orifice 84 is installed in an opening 86 formed axially through the metering piston 82. In this manner, fluid in the chamber 80 may be accurately metered through the orifice 84 when the piston 78 is axially downwardly biased by fluid pressure in the fluid passage 72. The orifice 84 may be of the commercially available type which is inserted into an opening, the orifice may be merely a small fluid passage formed in the metering piston 82, or may be otherwise provided without departing from the principles of the present invention.

The chamber 80 preferably contains a fluid such as hydraulic oil, silicone-based fluid, etc., which may be relatively accurately metered through the orifice 84 to produce a desired time delay range. For example, a relatively viscous fluid may be used to produce a relatively long time delay. Other adjustments may be made to produce desired time delays, such as, varying the restriction to fluid flow through the orifice 84 by changing the diameter of the orifice, varying the effective piston area of the piston 78, etc. The manner in which the time delay is utilized in operation of the choke 10 will be more fully described hereinbelow.

An annular chamber 88 is formed radially between the intermediate mandrel 76 and the piston housing 26 and axially between the metering piston 82 and an upper end 90 of the lower sub 28. A generally tubular spacer 94 is threadedly attached to the metering piston 82 and extends downwardly therefrom in the chamber 88 to axially space apart the metering piston from the upper end 90. Initially, the chamber 88 contains air or another gas, such as nitrogen, at approximately atmospheric pressure. The upper end 90 of the lower sub 28 is sealingly engaged between the intermediate mandrel 76 and the piston housing 26, the intermediate mandrel being axially reciprocably disposed within a bore 92 of the lower sub 28.

A generally C-shaped or spirally formed ring 96 is carried externally on the intermediate mandrel 76 axially between the piston 78 and the metering piston 82. The ring 96 limits axially downward displacement of the piston 78 relative to the intermediate mandrel 76 and, similarly, limits upward displacement of the metering piston 82. It is to be understood that other manners of limiting displacement of the pistons 78, 82 may be used without departing from the principles of the present invention, for example, internal and/or external shoulders may be formed on the intermediate mandrel 76 and/or piston housing 26, etc.

Thus, in the open configuration of the choke 10 representatively illustrated in FIGS. 1A–1E, the rupture disk 66 is isolating the chamber 64 from fluid pressure external to the outer housing assembly 12, the shear pin 70 is securing the operating mandrel 48 against axial displacement relative to the outer housing assembly, the operating mandrel is downwardly disposed, thereby maintaining the ball 16 in its open position with the opening 36 generally aligned with, and forming a portion of, the flow passage 14, the piston 78 is upwardly disposed, the chamber 80 is at approximately atmospheric pressure with fluid contained therein, the metering piston 82 is downwardly disposed with the spacer 94 contacting the upper end 90 of the lower sub 28, the intermediate mandrel 76 is upwardly disposed, and the chamber 88 is at approximately atmospheric pressure with a gas contained therein. This is the preferred configuration of the choke 10 as it is interconnected in a tubing string and run into a subterranean well. Of course, modifications may be made to this configuration without departing from the principles of the present invention.

Referring additionally now to FIGS. 2A–2E, the choke 10 is representatively illustrated in its choke configuration. In this configuration, fluid flow through the flow passage 14 is restricted as compared to that of the open configuration shown in FIGS. 1A–1E. The portion of the flow passage 14 extending through the ball 16 no longer passes through the opening 36—instead, it passes through a relatively small diameter flow restrictor 98 installed in an opening 100 formed through the ball 16 orthogonal to, and intersecting, the opening 36. Another opening 102 is formed through the ball 16 axially aligned with the opening 100 and intersecting the opening 36, the opening 102 also forming a portion of the flow passage 14.

Figure 2C:
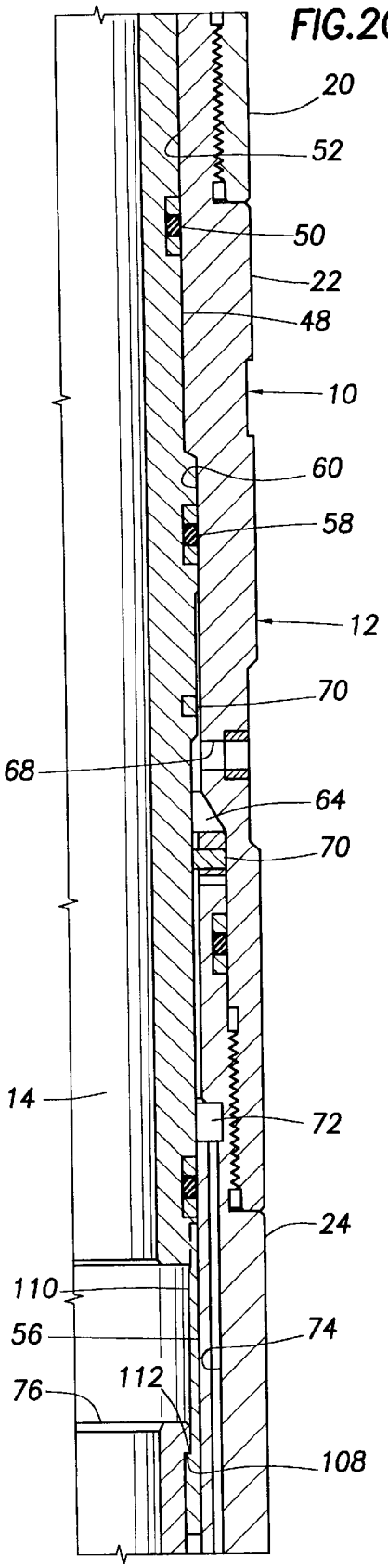

The ball 16 is shown in full cross-section in FIG. 2B, in order to more clearly illustrate the manner in which the flow restrictor 98 is removably installed therein, and to show the relationships between the various openings 36, 100, 102. It will be readily appreciated that, with the choke 10 in its representatively illustrated choke configuration as shown in FIGS. 2A–2E, the portion of the flow passage 14 extending axially through the ball 16 has been interchanged as compared to the open configuration of the choke as representatively illustrated in FIGS. 1A–1E, and the flow passage is now more restrictive to fluid flow therethrough.

The applicants prefer use of the separate flow restrictor 98 in the opening 100 for a number of reasons. For example, the separate flow restrictor 98 permits the degree of flow restriction to be conveniently changed by substituting another flow restrictor therefor, the flow restrictor 98 may be made of an erosion resistant material or other material without the necessity of making the entire ball 16 of the same material, etc. However, it is to be clearly understood that other manners of providing a flow restriction through the ball 16 may be utilized without departing from the principles of the present invention. For example, the opening 100 may provide such flow restriction without use of the separate flow restrictor 98, in which case the opening 100 could be internally coated with an erosion resistant material or other material, etc.

The flow restrictor 98 is retained within the ball 16 by a threaded ring 104. The flow restrictor 98 is sealingly engaged with the opening 100 by a seal 106 carried on the flow restrictor. Note that the opening 102 is somewhat larger in diameter than the flow restrictor 98 and opening 100, and is somewhat smaller in diameter than the opening 36 and the remainder of the flow passage 14. Thus, the opening 102 does not present a significant restriction to fluid flow through the ball 16, but it is to be understood that the opening 102 could be provided with a smaller diameter, so that it would restrict fluid flow therethrough.

In order to rotate the ball 16 to its position shown in FIG. 2B, fluid pressure external to the outer housing assembly 12 has been increased to a predetermined level to rupture the rupture disk 66. The rupture disk 66 is not shown in FIG. 2C, representing that it no longer isolates the chamber 64 from the fluid pressure external to the outer housing assembly 12. The fluid pressure is now present in the chamber 64 and the operating mandrel 48 is pressure unbalanced and upwardly biased by the fluid pressure.

The operating mandrel 48 has been upwardly displaced by the upwardly biasing force, thereby causing the actuator sleeves 30 to displace upwardly and rotate the ball 16 into its position as shown in FIG. 2B. The chamber 62 between the seals 50, 58 has been decreased by the upward displacement of the operating mandrel 48, and is no longer visible in FIG. 2C. The chamber 64 has, however, correspondingly increased.

The upwardly biasing force on the operating mandrel 48 has sheared the shear pin 70. In FIG. 2C the shear pin 70 is shown in two pieces, the operating mandrel 48 displacing one of the pieces axially upward therewith. Thus, the operating mandrel 48 is no longer secured against axial displacement relative to the outer housing assembly 12.

Figure 2D:
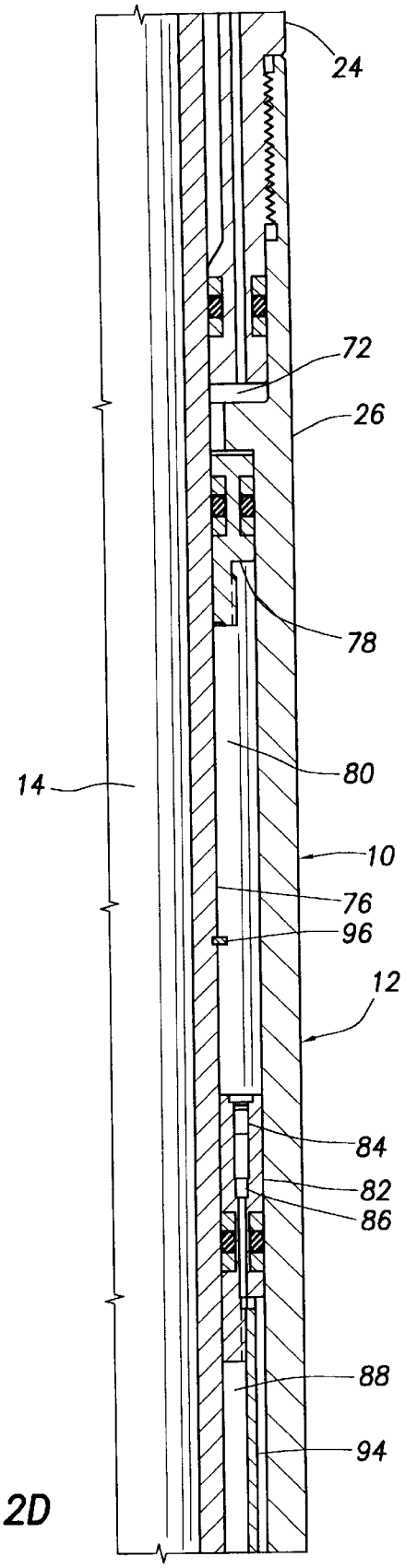
Figure 2E:
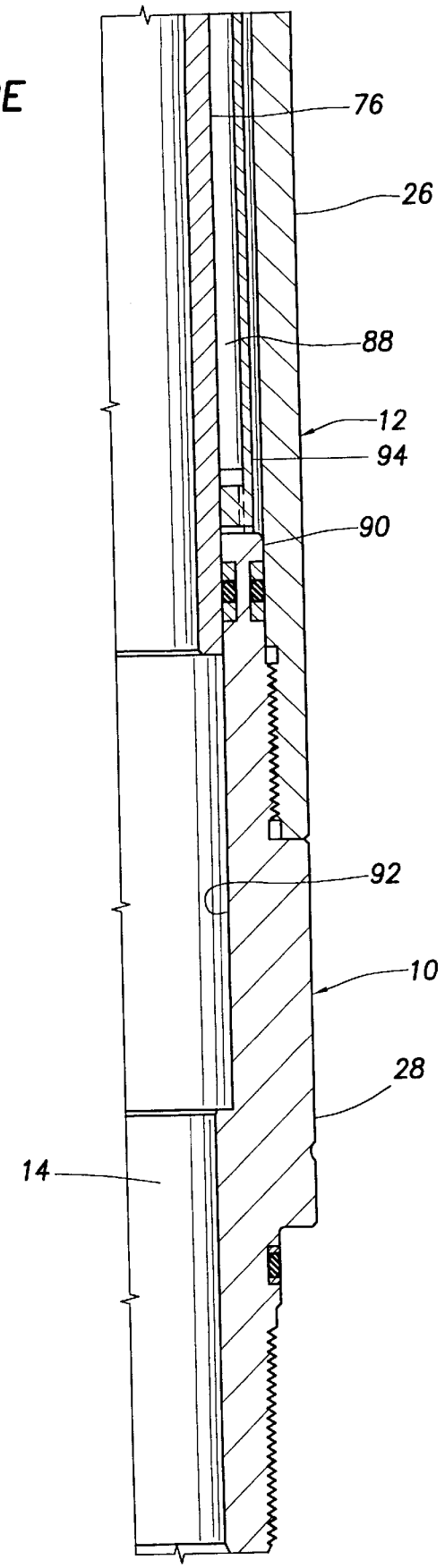
Figure 3C:
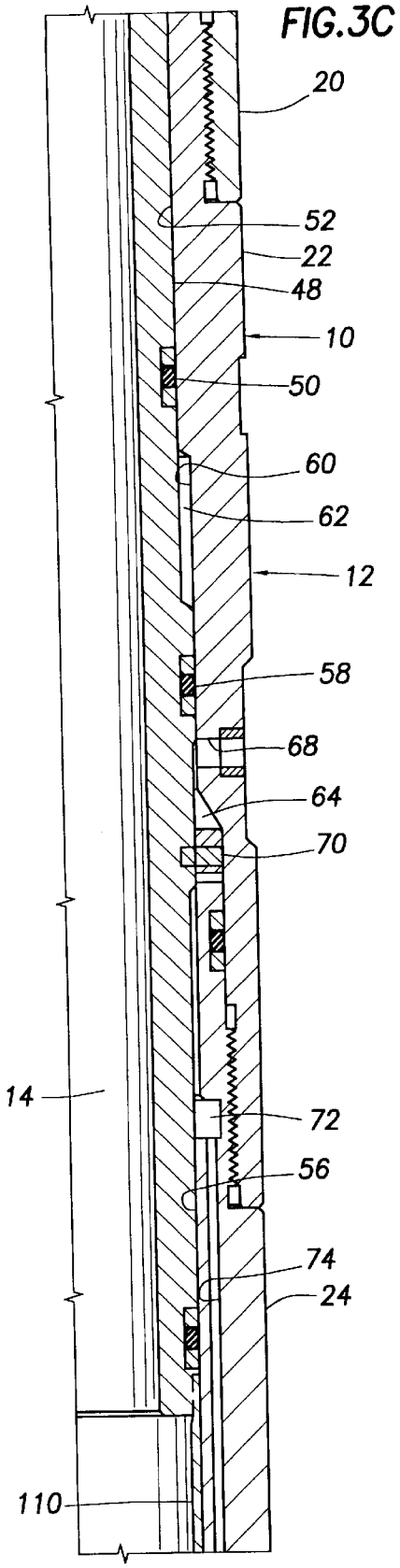
Figure 3D:
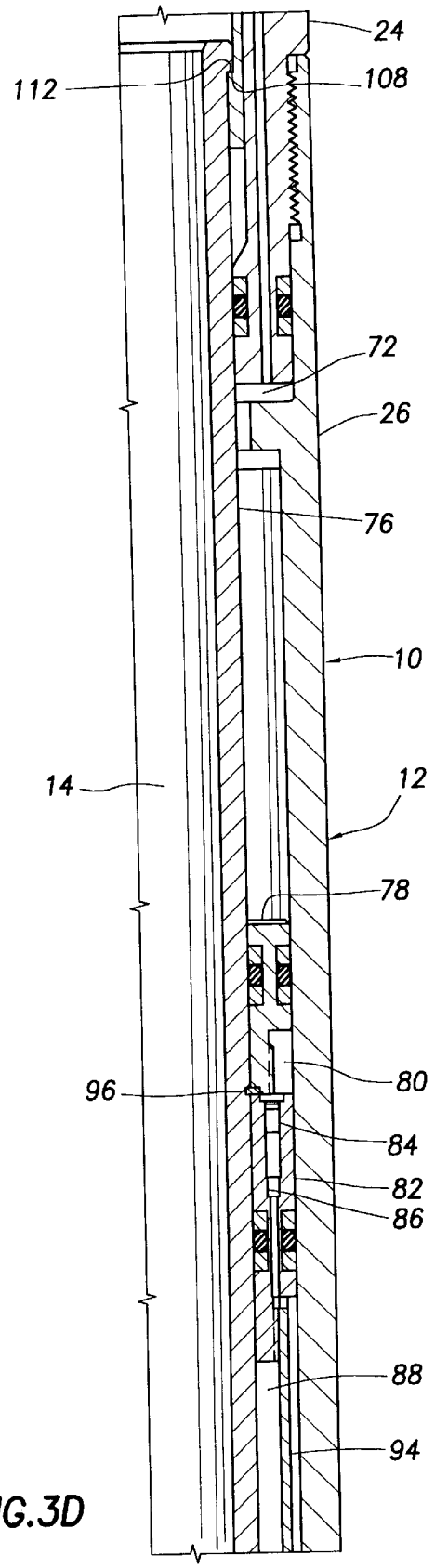
Figure 3E:
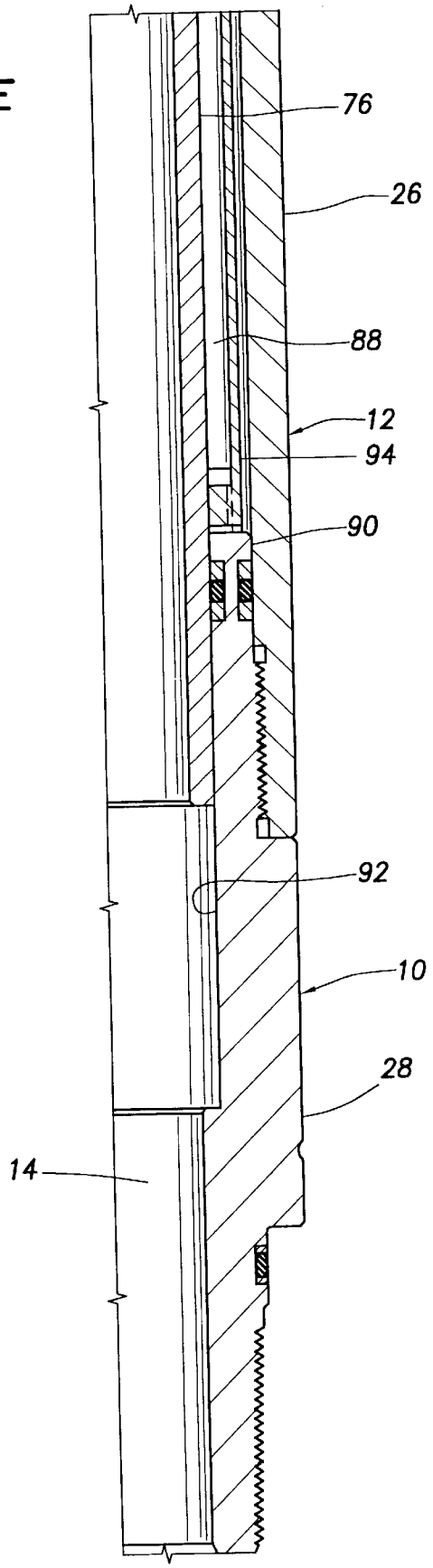

With the rupture disk 66 ruptured as shown in FIG. 2C, fluid pressure from the exterior of the outer housing assembly 12 is also permitted to enter the fluid passage 72. Thus, the piston 78 is now downwardly biased by a force produced by the fluid pressure in the fluid passage 72. Fluid in the chamber 80 is now pressurized by the downwardly biasing force applied to the piston 78. However, as shown in FIG. 2D, the fluid in the chamber 80 has not yet passed through the orifice 84 in the metering piston 82.

Note that an upper radially outwardly extending shoulder 108 formed on the intermediate mandrel 76 has axially contacted a radially inwardly extending shoulder 112 formed on a generally tubular extension 110 threadedly attached to the operating mandrel 48 and extending downwardly therefrom. Thus, at this point, the intermediate mandrel 76 and operating mandrel 48 are axially engaged with each other. In another way of viewing this, the intermediate mandrel 76 and operating mandrel 48 are telescopingly engaged, and in FIGS. 2A–2E the mandrels are shown fully axially extended. Therefore, if the intermediate mandrel 76 is axially downwardly displaced, the operating mandrel 48 will be displaced downwardly therewith.

Turning now to FIGS. 3A–3E, the choke 10 is representatively illustrated in a reopened configuration thereof. In this configuration, the opening 36 in the ball 16 is again aligned with, and forms a part of, the flow passage 14. Thus, in the reopened configuration of the choke 10, the flow passage 14 has had the flow restrictor 98 and opening 102 of the ball 16 interchanged for the opening 36, as compared tot he configuration of the choke shown in FIGS. 2A–2E.

The ball 16 has been rotated so that the opening 36 is aligned with the flow passage 14 by axially downwardly displacing the operating mandrel 48. When the operating mandrel 48 is downwardly displaced, the coupling 46 and actuator sleeves 30 are displaced therewith. Downward displacement of the actuator sleeves 30 causes rotation of the ball 16 back to its initial position as shown in FIG. 1B. With the opening 36 again aligned with the flow passage 14, substantially unrestricted flow is permitted through the flow passage.

The operating mandrel 48 is downwardly displaced by downward displacement of the intermediate mandrel 76. The piston 78 has displaced downwardly into axial contact with the ring 96, and continued to downwardly displace due to the biasing force exerted on it by the fluid pressure in the fluid passage 72. The chamber 80 between the piston 78 and the metering piston 82 has decreased in length, and so a substantial portion of the fluid in the chamber 80 has been forced through the orifice 84 into the chamber 88 below the metering piston.

The orifice 84 functions in part to slow the downward displacement of the piston 78, so that an extended time delay is created between rupture of the rupture disk 66 and downward displacement of the intermediate mandrel 76 to reopen the choke 10. Of course, this time delay may be predetermined by appropriate selection of the orifice 84 size, viscosity of the fluid in the chamber 80, etc., and such is well within the skill of an ordinary practitioner in the art.

In one method of using the choke 10, the choke is interconnected in a tubing string and positioned within a subterranean well. The choke 10 is in its open configuration when initially run into the well. When it is desired to perform a test on the well, fluids may be produced through the choke 10 in its open configuration, a predetermined fluid pressure may then be applied to the exterior of the outer housing assembly 12 to rupture the rupture disk 66 and shift the choke to its choke configuration, fluids may be produced through the then relatively restrictive flow passage 14, and then, after the time delay expires, the choke 10 will automatically shift to its reopened configuration. Thus, only a single application of fluid pressure is needed to perform the test on the well using the choke 10.

Referring additionally now to FIGS. 4A–4G & 5, an adaptation of some aspects of the present invention to a conventional item of equipment used in wellsite operations is representatively illustrated. The illustrated item of equipment is a tester valve 120 known as an LPR-N, manufactured by, and available from, Halliburton Company of Duncan, Okla., and is well known to those of ordinary skill in the art. It is to be understood that the tester valve 120 is illustrated and described herein as an example of adaptation of principles of the present invention to conventional equipment, and for convenience due to the fact that it is well known in the industry and a detailed recitation of its construction and operation is not needed herein. However, it is to be clearly understood that a wide variety of other items of equipment may incorporate principles of the present invention without departing therefrom.

Figure 4A:
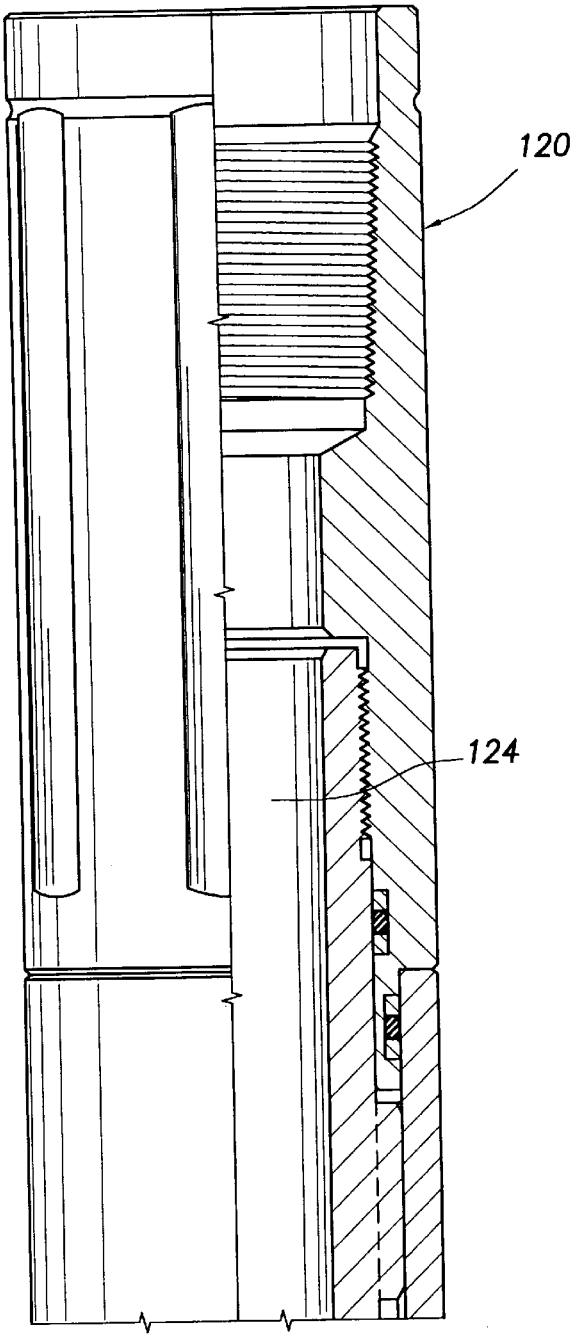
FIGS. 4A–4G are partially elevational and partially cross-sectional views of successive axial sections of another annulus pressure operated downhole choke embodying principles of the present invention.
Figure 4B:
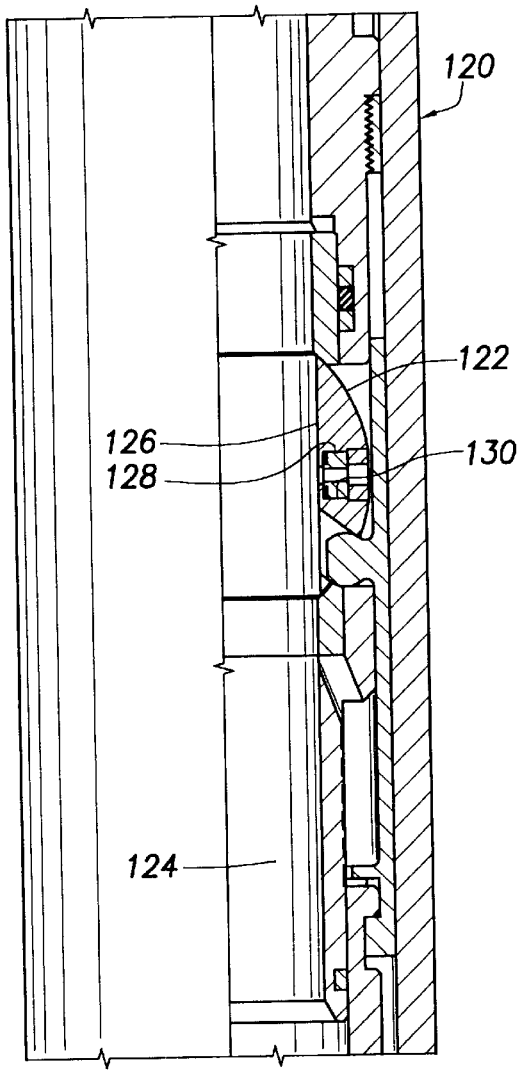
Figure 4C:
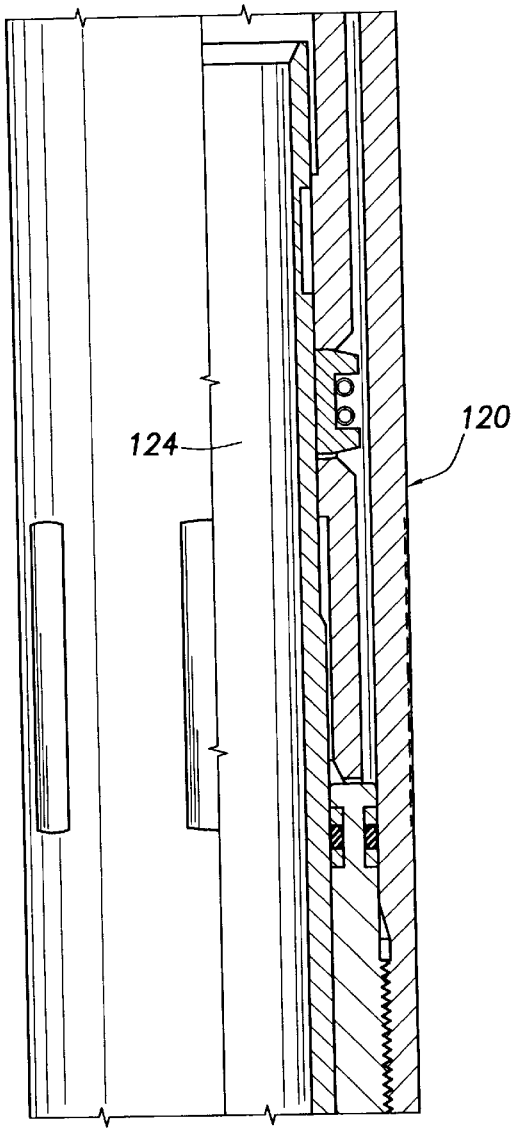
Figure 4D:
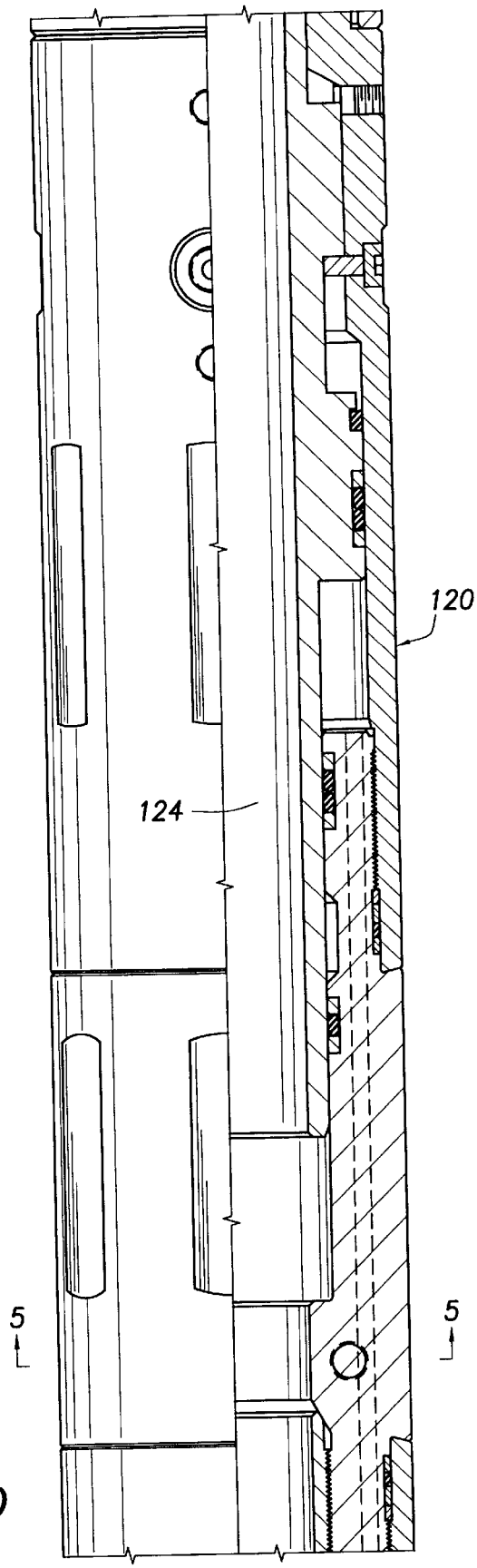
Figure 4E:
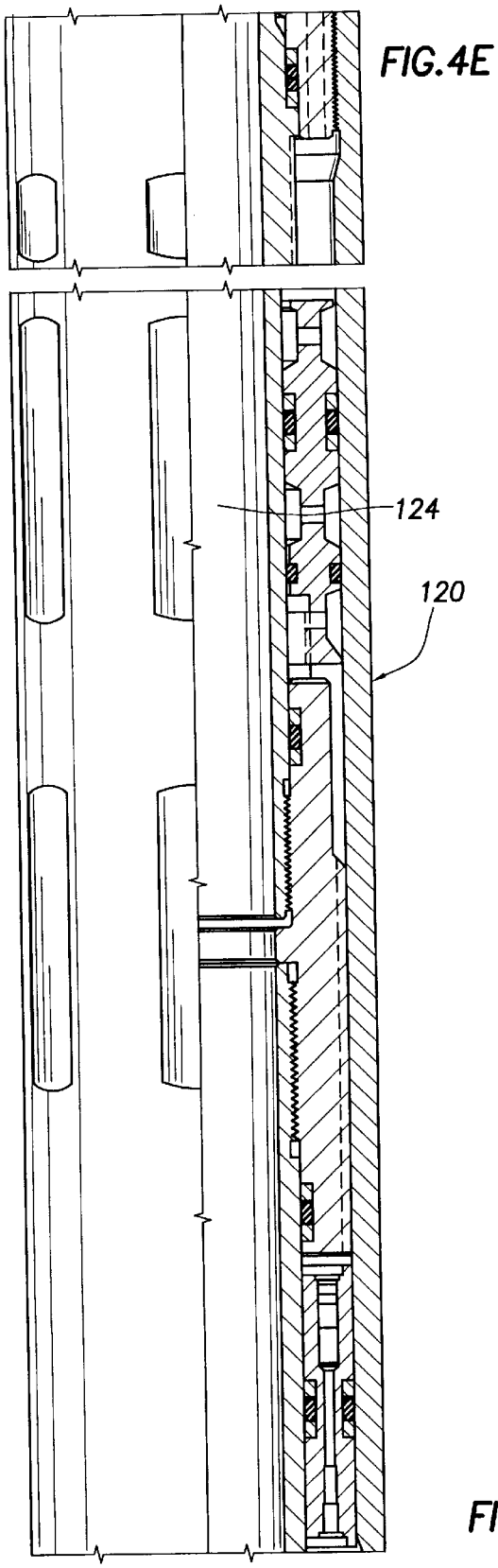
Figure 4F:
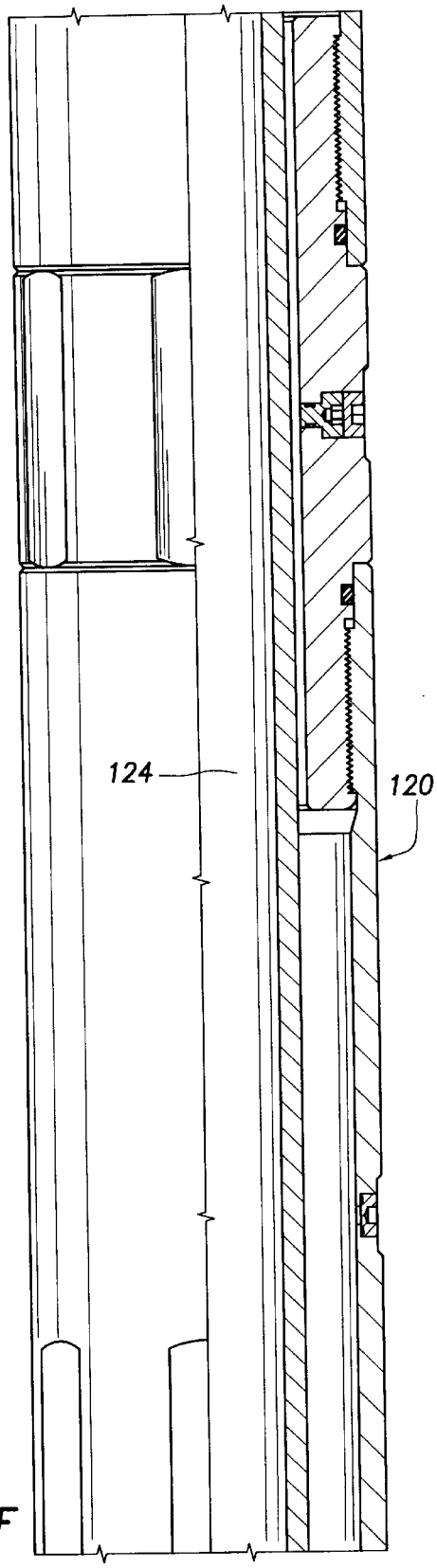
Figure 4G:
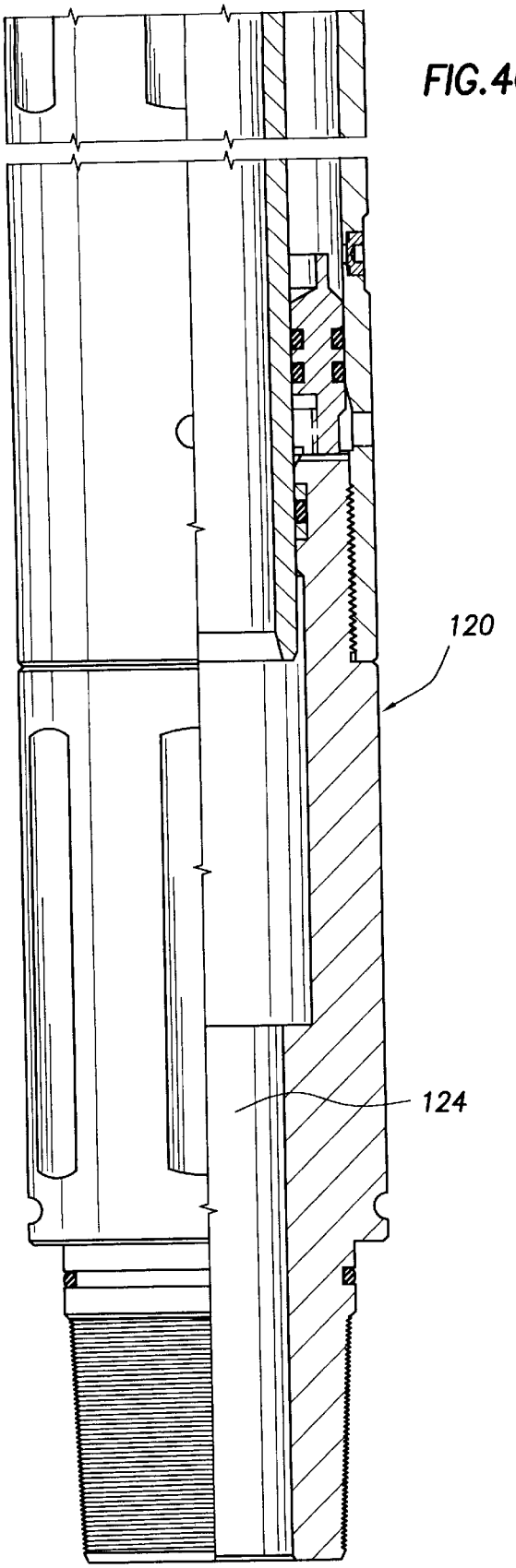
Figure 5:
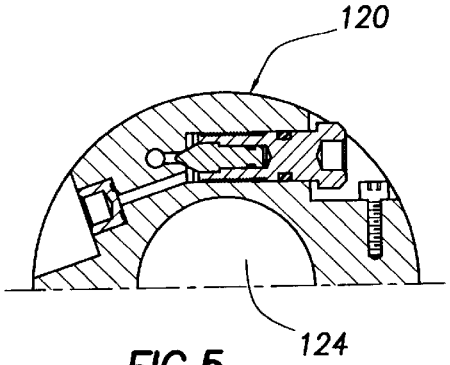
FIG. 5 is a cross-sectional view of the downhole choke of FIGS. 4A–4G, taken along line 5—5 of FIG. 4D.

It will be readily appreciated that an upper portion of the tester valve 120 shown in FIGS. 4A–4B is in many respects similar to an upper portion of the choke 10 shown in FIGS. 1A–1B. The tester valve 120 includes a closure member, or ball 122, which may be rotated relative to an axial flow passage 124 extending through the valve. The ball 122 has an opening 126 formed therethrough, the opening having a diameter and flow area approximately equal to that of the flow passage 124, so that the opening does not significantly restrict fluid flow therethrough.

The ball 122 also has a flow restrictor 128 installed in and sealingly engaged with an opening 130 formed through the ball and intersecting the opening 126. As shown in FIG. 4B, the opening 126 is aligned with the flow passage 124, so that the opening 126 forms a part of the flow passage. However, when the ball 122 is rotated with respect to the flow passage 124 to align the opening 130 with the flow passage, the flow restrictor 128 will form a part of the flow passage and will substantially restrict fluid flow therethrough. Another opening, similar to the opening 102 shown in FIG. 2B, is formed through the ball 122 to permit flow therethrough when the flow restrictor 128 is aligned with the flow passage 124.

It will, thus, be readily apparent to one of ordinary skill in the art that principles of the present invention may be incorporated into a variety of conventional items of equipment used in wellsite operations. Preferably, items of equipment so adapted will include a generally tubular housing with a flow passage extending generally axially through the housing, and a closure member displaceable relative to the flow passage. However, it is to be clearly understood that the housing may be other than tubular shaped, the flow passage may extend in directions other than axial, and the closure member may be other than a spherical member, without departing from the principles of the present invention.

Figure 6:
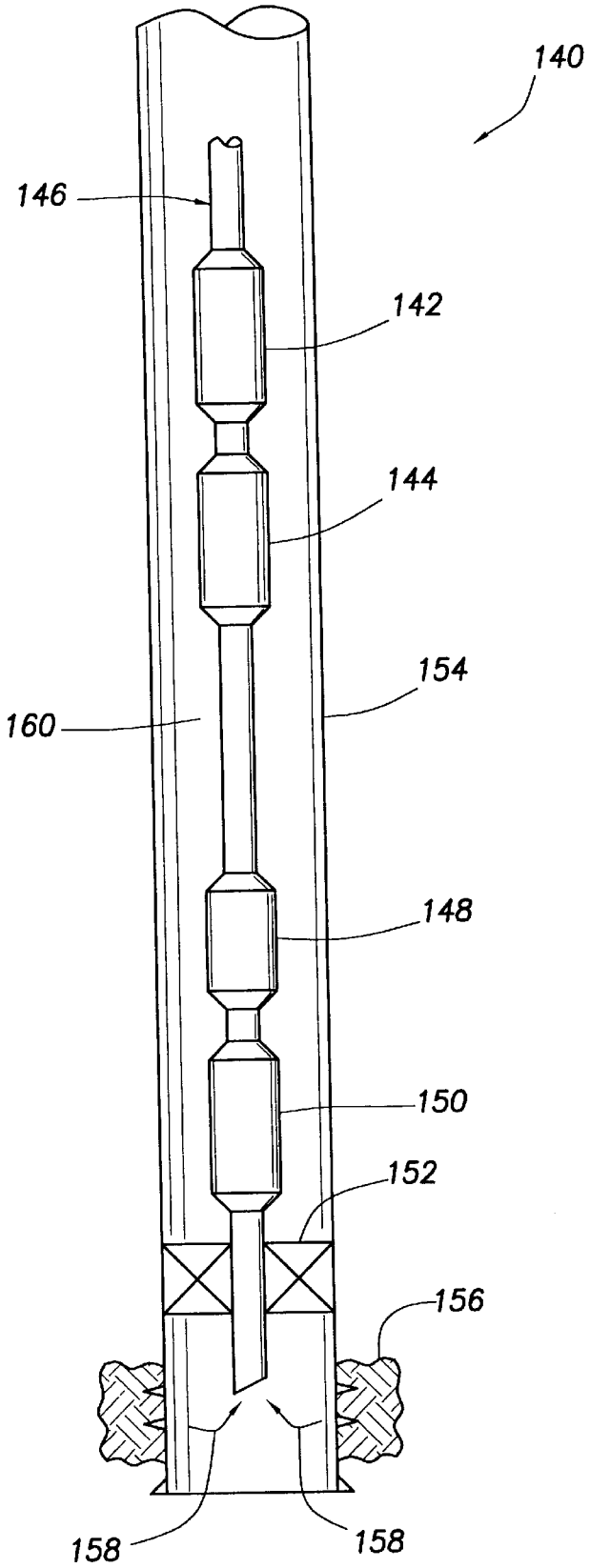
FIG. 6 is a schematic representation of a subterranean well, wherein methods of using an annulus pressure operated choke are performed.

Referring additionally now to FIG. 6, a method 140 of using an annular pressure operated choke is representatively illustrated. Two annulus pressure operated chokes 142, 144 are shown interconnected in a tubing string 146 extending to the earth's surface. Two fluid sampling devices 148, 150 are shown interconnected in the tubing string 146 below the chokes 142, 144, but above a packer 152 sealingly engaged between the tubing string 146 and protective casing 154 lining the wellbore. The packer 152 is set in the casing 154 above a productive formation, or interval of a formation 156, intersected by the wellbore.

The chokes 142, 144 may be similar to either of the chokes 10, 120 described hereinabove. The fluid sampling devices 148, 150 are conventional and are of the type which admit fluid from the interior of the tubing string 146 into sample chambers disposed therein. Two such fluid sampling devices 148, 150 are shown in FIG. 6, but it is to be understood that a single fluid sampling device having separately operable multiple chambers therein may be substituted for the multiple sampling devices.

Initially, fluid (indicated by arrows 158) may be flowed from the formation 156, into the tubing string 146, through the chokes 142, 144, and to the earth's surface through the tubing string. At this point, each of the chokes 142, 144 is in its open configuration, in which fluid flow therethrough is substantially unrestricted. When it is desired to perform a test, one of the chokes 142, 144 may be actuated to restrict fluid flow therethrough, the choke being actuated by applying a predetermined fluid pressure to an annulus 160 formed radially between the tubing string 146 and the casing 154.

With one of the chokes 142, 144 actuated so that it is in its choke configuration, one of the fluid sampling devices 148, 150 may be actuated to collect a sample of fluid 158 from within the tubing string 146. It will be readily appreciated that, with fluid flow being restricted through the tubing string by one of the chokes 142, 144, the sample collected will be at a fluid pressure greater than if fluid flow through the tubing string were not restricted. In this manner, the fluid sample may be collected in situ in conditions indicative of possible future production from the well.

If it is desired to collect another sample of the fluid 158 at a different flow rate through the tubing string 146, the other one of the chokes 142, 144 may be actuated to restrict fluid flow therethrough. Note that, when using the choke 10 described hereinabove for one or both of the chokes 142, 144 in the method 140, the first choke to be actuated will automatically reopen after expiration of the time delay, and the sample should be taken during that time delay. In that case, the second choke to be actuated may not be actuated until expiration of the time delay. Of course, the second choke could be actuated prior to expiration of the time delay, if desired.

Preferably, the second one of the chokes 142, 144 to be actuated has a restriction to fluid flow therethrough in its choke configuration which is different from that of the first one of the chokes to be actuated. For example, the second one of the chokes 142, 144 to be actuated may restrict fluid flow therethrough to a substantially reduced rate as compared to fluid flow through the first one of the chokes to be actuated. In this manner, fluid samples may be collected at different flow rates, different fluid pressures, etc. When later analyzed, the fluid samples may indicate an optimum flow rate, etc. at which the formation 156 should be produced, treatments, such as acidizing, that should be performed on the formation, etc.

The second one of the chokes 142, 144 to be actuated is preferably actuated by applying a predetermined fluid pressure to the annulus 160 which is greater than the fluid pressure applied to actuate the first one of the chokes. Thus, the chokes 142, 144 may be actuated in succession, and the fluid sampling devices 148, 150 may correspondingly acquire fluid samples into their sample chambers in succession, a first fluid sample being received in a first sample chamber after actuation of a first one of the chokes but before actuation of a second one of the chokes, and a second fluid sample being received in a second sample chamber after actuation of a second one of the chokes.

Preferably, steady state flow is established through an actuated one of the chokes 142, 144 before taking a fluid sample from within the tubing string 146 by one of the fluid sampling devices 148, 150, but it is not necessary for such steady state flow to be established in a method according to principles of the present invention. Note that steady state flow through an actuated one of the chokes 142, 144 may be established in much less time than if a surface installed choke were utilized. This is due to the fact that the chokes 142, 144 in the method 140 are positioned closer to the formation 156 than to the earth's surface.

Of course, many modifications, additions, deletions, substitutions, and other changes may be made to the chokes and/or methods described herein, which changes would be obvious to one of ordinary skill in the art. For example, the closure member in a choke made in accordance with the principles of the present invention may be planar in shape rather than spherical, the time delay mechanism may be modified or eliminated, etc. These changes and others are contemplated by the principles of the present invention. Accordingly, the foregoing detailed description is to be clearly understood as being given by way of illustration and example only, the spirit and scope of the present invention being limited solely by the appended claims.

What is claimed is:

1. A choke operatively positionable within a subterranean wellbore having a tubular string disposed therein, the apparatus comprising:

a generally tubular outer housing assembly having opposite ends, each of the opposite ends being attachable to the tubular string to interconnect the choke therein;

a flow passage extending generally axially through the outer housing assembly, the flow passage being in fluid communication with the interior of the tubular string when the choke is interconnected therein; and a closure member disposed within the outer housing assembly and positionable relative to the flow passage in a selected one of a first position in which the closure member permits substantially unrestricted fluid flow through the flow passage, and a second position in which the closure member permits substantially restricted fluid flow through the flow passage.

2. The choke according to claim 1, wherein the closure member is displaceable relative to the flow passage by applying fluid pressure to an annulus formed radially between the outer housing assembly and the wellbore.

3. The choke according to claim 1, further comprising a shear member, the shear member shearing to permit displacement of the closure member from the first position to the second position when a predetermined fluid pressure is applied to the outer housing assembly.

4. The choke according to claim 3, wherein the shear member comprises a rupture disk, the rupture disk admitting the predetermined fluid pressure into the outer housing assembly when the predetermined fluid pressure is applied thereto.

5. The choke according to claim 1, further comprising a generally tubular operating mandrel attached to the closure member, the operating mandrel displacing the closure member relative to the flow passage when the operating mandrel is displaced relative to the outer housing assembly.

6. The choke according to claim 5, further comprising a piston disposed within the outer housing assembly, the piston displacing relative to the operating mandrel when fluid pressure is applied thereto.

7. The choke according to claim 6, wherein the piston displaces relative to the operating mandrel when a predetermined fluid pressure is applied externally to the outer housing assembly.

8. The choke according to claim 6, further comprising an intermediate mandrel attached to the operating mandrel, and wherein the piston engages the intermediate mandrel to displace the intermediate mandrel and the operating mandrel relative to the outer housing assembly when fluid pressure is applied to the piston.

9. The choke according to claim 8, wherein the intermediate mandrel is telescopingly attached to the operating mandrel.

10. The choke according to claim 8, wherein the operating mandrel is releasably secured against displacement relative to the outer housing assembly.

11. The choke according to claim 8, further comprising an orifice disposed within the outer housing assembly, and wherein the piston forces fluid through the orifice to thereby provide a time delay between application of fluid pressure to the piston and displacement of the intermediate mandrel relative to the outer housing assembly.

12. The choke according to claim 8, wherein the operating mandrel displaces the closure member from the first position to the second position when the predetermined fluid pressure is applied externally to the outer housing assembly, and wherein the operating mandrel displaces the closure member from the second position to the first position when the piston engages and axially displaces the intermediate mandrel relative to the outer housing assembly.

13. The choke according to claim 12, further comprising a fluid chamber and an orifice disposed within the outer housing assembly, the piston forcing fluid from the fluid chamber through the orifice when fluid pressure is applied to the piston to thereby provide a time delay between when the operating mandrel displaces the closure member from the second position to the first position and when the piston displaces the intermediate mandrel relative to the outer housing assembly.

14. A choke operatively positionable within a subterranean well, the choke comprising:

a generally tubular outer housing having a generally axially extending flow passage formed therethrough;

a generally spherical closure member rotationally disposed relative to the flow passage within the outer housing, the closure member having a first opening formed therethrough and a second opening formed therein, and the closure member being positionable relative to the flow passage in a selected one of a first position in which the first opening is generally aligned with the flow passage and permits substantially unrestricted fluid flow therethrough, and a second position in which the second opening is generally aligned with the flow passage and permits choked fluid flow therethrough.

15. The choke according to claim 14, wherein the first and second openings intersect within the closure member.

16. The choke according to claim 14, wherein the closure member further has a third opening formed therein, and wherein the third opening is generally aligned with the second opening and the flow passage when the closure member is in the second position.

17. The choke according to claim 16, wherein the second and third openings are formed generally radially through the closure member and are generally diametrically aligned with each other.

18. The choke according to claim 16, wherein the third opening has a diameter greater than that of the second opening and less than that of the first opening.

19. The choke according to claim 14, further comprising a flow restrictor member attached to the closure member and disposed adjacent the second opening.

20. The choke according to claim 19, wherein the flow restrictor member is made of a material having an erosion resistance greater than that of the closure member.

21. The choke according to claim 19, wherein the flow restrictor member has a third opening formed therethrough, the third opening being generally aligned with the second opening, and the third opening having a diameter less than that of the second opening.

22. The choke according to claim 21, wherein the closure member is sealingly disposed within the outer housing, and wherein the flow restrictor member is sealingly engaged with the closure member, so that when the closure member is in the second position, fluid flow axially through the flow passage is constrained to flow through the second and third openings.

23. A method of controlling fluid flow through a tubular string disposed within a subterranean wellbore, the method comprising the steps of:

interconnecting a downhole choke in the tubular string;

positioning the downhole choke within the wellbore;

flowing fluid axially through the downhole choke;

actuating the downhole choke to choke fluid flow therethrough; and establishing steady state flow through the downhole choke after actuating step.

24. The method according to claim 23, further comprising the step of obtaining a sample of fluid flowing through the tubular string after the step of establishing steady state flow.

25. The method according to claim 23, wherein the step of positioning the downhole choke further comprises positioning the downhole choke closer to a formation from which the fluid flow originates than to the earth's surface.

26. The method according to claim 23, wherein the actuating step further comprises applying fluid pressure to an annulus formed radially between the tubular string and the wellbore.

27. The method according to claim 26, wherein the applying step further comprises applying a predetermined fluid pressure to the annulus to thereby cause a portion of a flow passage formed through the downhole choke to have a reduced flow area therein.

28. The method according to claim 27, further comprising the step of actuating the downhole choke to permit substantially unrestricted fluid flow therethrough.

29. The method according to claim 28, wherein substantially unrestricted fluid flow is permitted through the downhole choke simultaneously with the step of applying the predetermined fluid pressure to the annulus.

30. The method according to claim 28, further comprising the step of providing a time delay between the step of actuating the downhole choke to choke fluid flow therethrough and the step of actuating the downhole choke to permit substantially unrestricted fluid flow therethrough.

31. The method according to claim 30, wherein the predetermined fluid pressure is substantially continuously applied during the time delay.

32. A method of testing a subterranean well which intersects a fluid producing formation, the method comprising the steps of:

interconnecting a choke and a sample chamber in a tubing string;

positioning the tubing string within the well;

actuating the choke to temporarily choke fluid flow through the tubing string;

establishing steady state flow through the downhole choke after the actuating step; and acquiring a sample of fluid from the tubing string into the sample chamber while fluid flow through the tubing string is temporarily choked by the choke.

33. The method according to claim 32, wherein the interconnecting step further comprises connecting the sample chamber below the choke in the tubing string.

34. The method according to claim 32, further comprising the step of providing the choke having a time delay mechanism, and wherein in the actuating step the time delay mechanism determines the amount of time the fluid flow is choked.

35. The method according to claim 32, wherein the actuating step further comprises applying a predetermined fluid pressure to the choke to begin the temporary choking of fluid flow therethrough.

36. The method according to claim 35, wherein the predetermined fluid pressure is substantially continuously applied during the temporary choking of fluid flow therethrough.

37. The method according to claim 36, wherein the actuating step further comprises displacing a closure member of the choke relative to a flow passage of the choke to thereby substantially restrict fluid flow through the flow passage.

38. A method of sampling fluid from a subterranean well, the well having a wellbore intersecting a fluid producing formation, the method comprising the steps of:

interconnecting first and second sample chambers and first and second chokes in a tubing string, the first sample chamber being positioned below the first choke and the second sample chamber being positioned below the second choke;

disposing the tubing string within the wellbore;

flowing fluid from the formation through the tubing string to the earth's surface;

actuating the first choke to restrict fluid flow therethrough;

acquiring a first sample of fluid from within the tubing string into the first sample chamber;

actuating the second choke to restrict fluid flow therethrough; and acquiring a second sample of fluid from within the tubing string into the second sample chamber.

39. The method according to claim 38, wherein the first choke includes a time delay mechanism, the time delay mechanism causing the first choke to automatically permit substantially unrestricted fluid flow therethrough an amount of time after the step of actuating the first choke.

40. The method according to claim 39, wherein the step of acquiring the first sample of fluid is performed during the amount of time after the step of actuating the first choke.

41. The method according to claim 38, wherein in the second choke actuating step, fluid flow is restricted therethrough at a substantially reduced rate as compared to fluid flow restriction through the first choke in the first choke actuating step.

42. The method according to claim 38, wherein the first choke actuating step is performed by applying a first predetermined fluid pressure to an annulus formed between the tubing string and the wellbore, and wherein the second choke actuating step is performed by applying a second predetermined fluid pressure to the annulus.

43. The method according to claim 38, further comprising the step of establishing substantially steady state fluid flow through the first choke after the first choke actuating step and before the first sample acquiring step.

44. The method according to claim 38, wherein the disposing step further comprises positioning the first choke closer to the formation than to the earth's surface.

45. The method according to claim 38, wherein the disposing step further comprises positioning the first choke closer than the second choke to the earth's surface.

* * * * *